United States Patent [19]

Arrigoni et al.

[11] Patent Number: 4,644,701

[45] Date of Patent: Feb. 24, 1987

[54] HAND OPERATED GRINDING WHEEL WITH SURFACE AREA AND DEPTH CONTROL

[75] Inventors: John P. Arrigoni, Wallingford; Kenneth C. Carlson, Forestville, both of Conn.

[73] Assignee: United Technologies Corporation, Hartford, Conn.

[21] Appl. No.: 728,544

[22] Filed: Apr. 29, 1985

[51] Int. Cl.[4] ..... B24B 5/36; B24B 17/02

[52] U.S. Cl. ..... 51/241 S; 51/289 R; 409/97; 409/110; 409/204

[58] Field of Search ..... 51/241 R, 241 S, 241 B, 51/251, 289 R; 409/97, 110, 124, 125, 139, 140, 178, 179, 204, 214, 218

[56] References Cited

U.S. PATENT DOCUMENTS 4,271,638 6/1981 Creech ..... 409/204

FOREIGN PATENT DOCUMENTS 138009 10/1979 Fed. Rep. of Germany .... 51/241 S

*Primary Examiner*—Roscoe V. Parker

*Attorney, Agent, or Firm*—Normasn Friedland

[57] ABSTRACT

The shaft of a jet engine is reworked by removing the original plating, and the plating adjacent the oil hole in the shaft is removed by a hand grinding operation. The hand grinder includes means for supporting the grinding wheel with means for controlling the area and depth of the grinding.

6 Claims, 5 Drawing Figures

HAND OPERATED GRINDING WHEEL WITH SURFACE AREA AND DEPTH CONTROL

TECHNICAL FIELD

This invention relates to tools and particularly to a hand operated grinding wheel for selectively removing coating from a cylindrical shaft.

BACKGROUND ART

As is well known, reworking of a shaft for a gas turbine engine requires the removal of the outer coating on the shaft down to the parent metal and recoating the shaft to exactly its original dimension. Inherent in this process is that the entire surface of the shaft, at least at the bearing location, is coated; including the surface adjacent the lubrication holes in the shaft. It is necessary to obviate cracking problems that are susceptible in the coating in this vicinity that are occasioned when the shaft is operating. Thus, this localized coating must be removed without removal of the parent metal of the shaft prior to reassembling the shaft in the engine.

The heretofore method of this removal operation is to hand grind this area with a hand grinding tool. Obviously, the exactness of this technique was totally dependent on the skill of the operator of the grinder. Historically, this task was not only time consuming, but because of the exactness required, the incidence of rejecting the shafts because of poor grinds was high.

Another method heretofore used hand grind and chemically strip to remove the coating from the entire bearing journal (360°). The area around the oil hole was then masked and the journal was recoated. This method, obviously, was expensive, time consuming and did not preclude leaking masks.

DISCLOSURE OF INVENTION

We have found that we can obviate these problems noted above by providing a fixture supporting a grinding wheel that is judiciously supported by and guided by the shaft being ground which fixture has indexing means for locating the grinding wheel relative to the surface being grounded and having means for controlling the depth and area of the grind.

A feature of this invention is to provide for a grinding wheel means for support and controlling the depth and grinding area independent of the actions of the operator of the grinding wheel.

A further feature of this invention is to provide flexible guide rails having adjustable depending legs bearing against the shaft to be ground with a screw adjustment between the rails to raise and lower the grinding wheel by flexing the rails into and away from each other.

A further feature of this invention is to provide a removable indexing tool that locates the grinding wheel relative to the centerline of the hole in the shaft and a stylus operating in a template for constraining the longitudinal and axial motion of the grinding wheel for controlling the area of the surface where the coating is being removed.

Other features and advantages will be apparent from the specification and claims and from the accompanying drawings which illustrate an embodiment of the invention.

BEST MODE FOR CARRYING OUT THE INVENTION

This invention has been extremely efficacious in reworking the shafts of the JT-8D manufactured by Pratt & Whitney Aircraft of United Technologies Corporation, the common assignee to this patent application and it is described herein as the preferred embodiment. However, as will be apparent from the description to follow this invention has application for the selective removal of a plating or coating of a curved surface where depth control is important.

Figure 2:
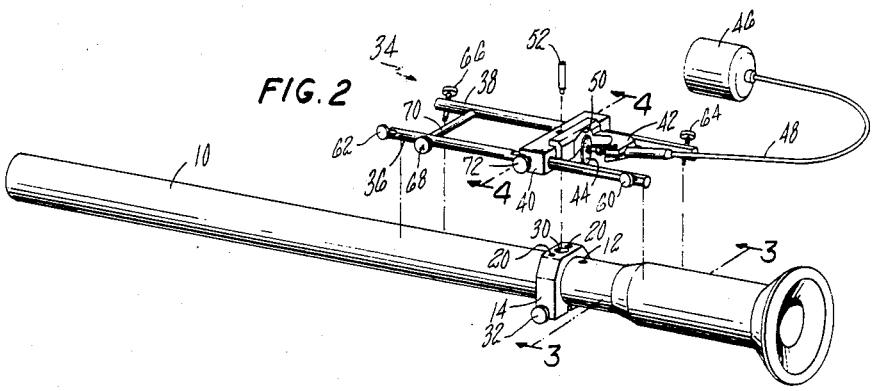
FIG. 2 is an exploded view in perspective showing the shaft of FIG. 1 and the fixture for the hand operated grinding wheel
Figure 3:
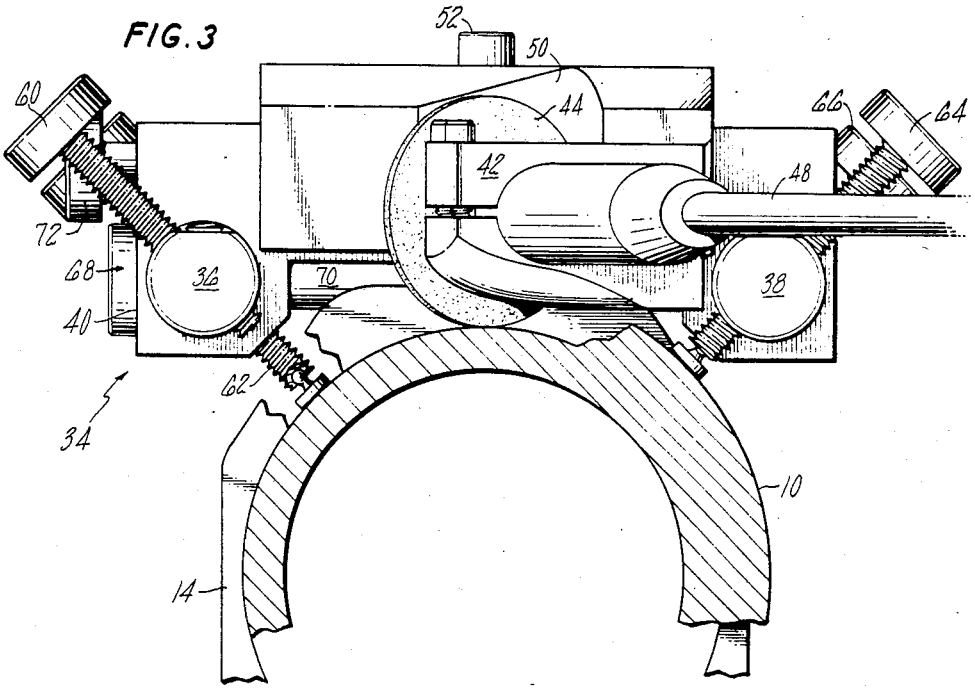
FIG. 3 is a side view in elevation and a partial sectional view taken along lines 3—3 of FIG. 2.

To understand this invention it is best to consider the various steps taken to get to the point where the grinding operation takes place. This is best understood by considering FIGS. 1–3.

Figure 1:
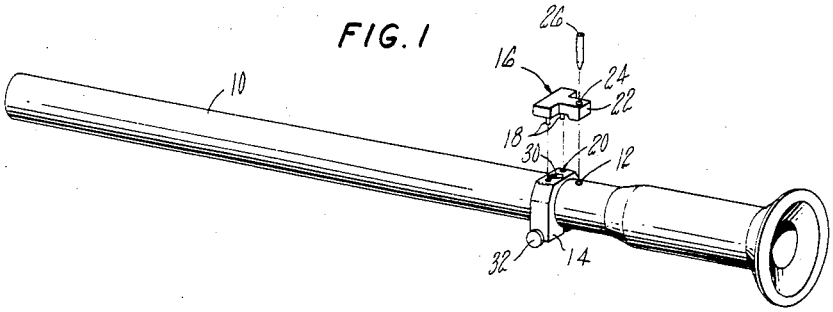
FIG. 1 is an exploded view in perspective showing a typical shaft being reworked and the template of the grinding tool with the indexing and location relative to the centerline of the hole in the shaft.

In FIG. 1 the stepped shaft 10 is the item that is being worked. At this point the shaft has already been reworked with the new coating, which is in this instance chromium plating. As mentioned above the objective is to remove the chromium around the oil hole 12 in shaft 10 without removing any of the parent material of the shaft.

A template 14 having an inner diameter slightly larger than the outer diameter of the shaft is fitted onto the shaft in proximity to the oil hole 12. An indexing tool 16 with a pair of locating dowels 18 fits into the cooperating holes 20 formed in the top surface of template 14. The axial extending portion 22 overlies the oil hole 12 and the aperture 24 formed in portion 22 is adjusted to line up with this hole. A helping tool 26 fits through aperture 24 and the conical tip adjusts itself within the oil hole 12 so that the centerline of oil hole 12 is indexed to the centerline of the aperature 30 in template 14. The template is split on the bottom half and the screw adjustment 32 is adjusted to secure template 14 to shaft 10. The indexing tool 16 and the helping tool 26 are then removed.

The grinding fixture generally indicated by reference numeral 34 comprises a pair of parallelly spaced rails 36 and 38 held in spaced relationship by the movable carriage 40. Carriage 40 carries a grinder support block 42 that supports the grinding wheel or cutter 44. The grinding wheel is rotatably driven by an electric motor 46 driving the flexible shaft 48 of the grinding wheel. The shaft and motor are commercially available and any suitable type can be used to practice the invention. It is to be understood, however, that the grinding wheel is preferably locked into position when its cutting axis is in coincidence with the centerline of the oil hole 12. This is easily accomplished by indexing the wheel relative to the inner surface 50 of the support block 42.

The proper sized stylus 52 is selected to give the desired surface area to be removed and fits into aperture 54 and projects into the circular recess 30 formed in template 14. This controls the lateral and axial motion of the grinding fixture 34 as the hand operator works it.

Rails 36 and 38 each carry a pair of adjustable depending feet 60, 62, 64 and 66. The front feet 62 and 66 bear on the smaller diameter of shaft 10 and the rear feet 60 and 64 bear on the larger diameter when the grinding fixture is set in place. Because of the angular displacement of each pair of feet the in and out adjustment adjust the height of the grinding fixture 34.

In operation the feet are adjusted to give a rough approximation of the height of the cutting edge of the grinding wheel 44 so that it is in close proximity to the outer diameter of the chromium plate.

Fine adjustment is obtained by the flexing adjustment 68. The flexing adjustment comprises a threaded bolt 69 threadedly engaging complementary threads formed in rail 38 and loosely fitting through an enlarged hole 71 formed in rail 36 (see FIG. 4). Before adjusting the feet (60, 62, 64 and 66) the bolt 69 is tightened to prestress the rails in the bending mode. Collar 70, loosely fitted over the bolt 69 serves to limit the minimum displacement. The material (metal) selected for the rails is characterized by its flexibility and resiliency so that it inherently returns to the straightened position. By proper selection of the threads, and dimension of the head of the bolt the rotation thereof has a predetermined vertical displacement relative to shaft 10. Hence a $\frac{1}{4}$ turn, say, will cause the cutting edge of the grinding wheel to drop 0.0002 of an inch.

Figure 4:
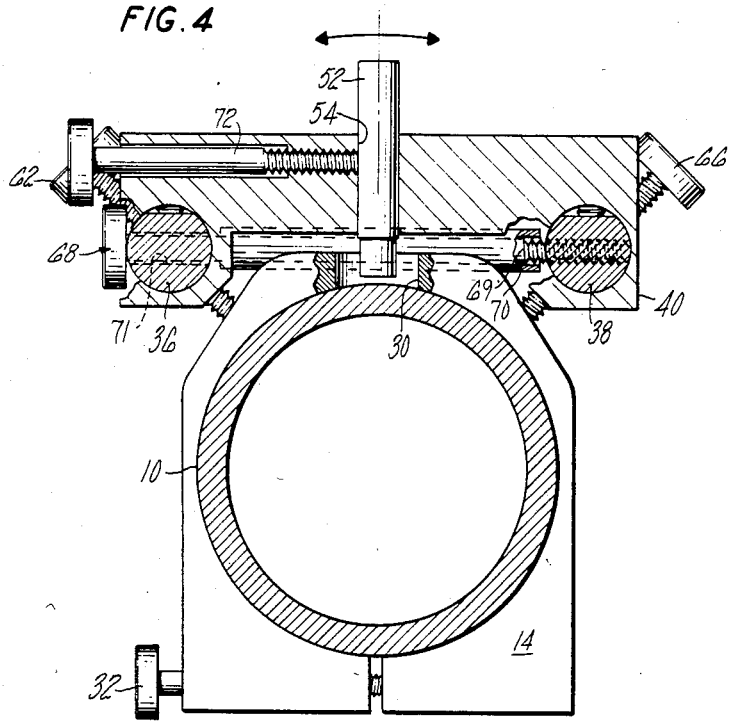
FIG. 4 is a section taken through line 4—4 of FIG. 2 showing the stylus in the template.

As is apparent from the foregoing once the proper sized stylus is selected and inserted in the carriage its height (that portion protruding through the bottom) is adjusted to a point above the outer diameter of the shaft. The bolt 72 is then set to lock the stylus in place (FIG. 4). The operator can then commence grinding by moving the grinding fixture at will which is constrained by the circular boundary of recess 30 in the template 14. Since the grinding fixture 34 rests on the outer surface of the shaft it will follow the contour. The operator continues to grind and reset the flexing adjustment until the coating is removed. This is generally known by using a litmus type of test by exposing the ground surface to a chemical that will react with the parent metal by changing its color and not with the plating or vice versa. Skilled operators can identify the parent material merely by the change of color of the sparks.

Figure 5:
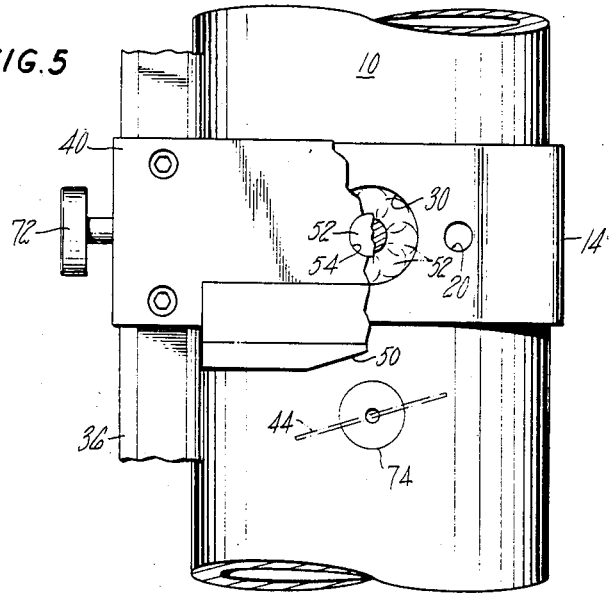
FIG. 5 is a partial view in elevation illustrating the relationship of the template and the area ground by the hand operated fixture

Referring to FIG. 5, the stylus 52 operating within the recess 30 will limit the area of the removal of the coating as depicted by the circle. Hence the operator will continue to grind until the coating surrounding oil hole 12 is removed as defined by circle 74.

It should be understood that the invention is not limited to the particular embodiments shown and described herein, but that various changes and modifications may be made without departing from the spirit and scope of this novel concept as defined by the following claims.

We claim:

1. A hand operated grinding tool for removing material from a preselected surface surrounding an oil hole in a cylindrical shaft comprising, a pair of elongated parallelly disposed rails, a carriage slideably supported by said rails, a pair of extending adjustable feet supported on opposite ends of each of said rails adapted to bear against the cylindrical shaft when in the grinding position, means for locking said carriage in a predetermined position relative to said oil hole, a template fixed to said shaft at a predetermined position relative to said oil hole, a retractable stylus extending from said carriage adapted to be guided by said template to form a circular pattern that said grinding wheel can be positioned by an operator, said carriage supporting a grinding wheel in fixed relation to said carriage, means for flexing said rails to allow them to move vertically relative to said preselected surface to regulate the depth of said grinding wheel relative to said outer diameter of said cylindrical shaft, and means for imparting rotary motion to said grinding wheel.

2. A hand operated grinding tool as in claim 1 wherein said flexing means includes a threaded bolt having one end threaded to one of said rails and the other end passing freely through an opening in the other of said rails.

3. A hand operated grinding tool as in claim 2 including a cover surrounding said bolt between said rails and abutting said rails to define the minimum spacing between said rails.

4. A hand operated grinding tool as in claim 1 including a removable indexing tool having a pair of spaced dowels adapted to fit into opening on said template and an extending portion having an opening intended to overlie the oil hole to a predetermined distance relative to said template whereby said oil hole will be indexed to said grinding wheel and means for setting said template to be fixed to said shaft.

5. A hand operated grinding tool as in claim 4 wherein said setting means for said template includes a threaded set screw and said template includes a generally rectangular shaped body having an upper flat surface and a lower split flat surface, a bore to loosely fit said shaft and said set screw adapted to position said split flat surface to reduce the diameter of said bore to frictionally engage said shaft.

6. A hand operated grinding tool as in claim 5 including a removable helping tool having a cylindrical body and a conical tip adapted to fit into the oil hole to align with the centerline of said oil hole.

* * * * *